US009889549B2

(12) United States Patent
Lin

(10) Patent No.: US 9,889,549 B2
(45) Date of Patent: Feb. 13, 2018

(54) PRECISION HANDLE FOR HAND TOOLS

(71) Applicant: Shyang Yun Tools Co., Ltd., Taichung (TW)

(72) Inventor: Chia-Szu Lin, Taichung (TW)

(73) Assignee: Shyang Yun Tools Co., Ltd., Taichung (TW)

( * ) Notice: Subject to any disclaimer, the term of this patent is extended or adjusted under 35 U.S.C. 154(b) by 276 days.

(21) Appl. No.: 14/716,145

(22) Filed: May 19, 2015

(65) Prior Publication Data

US 2016/0339580 A1 Nov. 24, 2016

(51) Int. Cl.
*B25G 1/04* (2006.01)
*B25G 1/10* (2006.01)

(52) U.S. Cl.
CPC ..... *B25G 1/046* (2013.01); *B25G 1/105* (2013.01)

(58) Field of Classification Search
CPC ..... B25G 1/046; B25G 1/105; B25B 15/02; B25B 15/04; B25B 15/06
See application file for complete search history.

(56) References Cited

U.S. PATENT DOCUMENTS 2,351,705 A * 6/1944 Prall ..... B25G 1/046 81/436
2,564,356 A * 8/1951 Dianda ..... B25B 15/02 81/177.1
7,958,804 B2 * 6/2011 Badiali ..... B25G 1/005 16/430
2005/0139046 A1 * 6/2005 Hsieh ..... B25G 1/046 81/492
2008/0196199 A1 * 8/2008 Lin ..... B25B 15/02 16/110.1
2009/0255386 A1 * 10/2009 Liao ..... B25B 13/06 81/474

FOREIGN PATENT DOCUMENTS

DE 29701978 U1 * 4/1997 ..... B25G 1/046
FR 924131 A * 7/1947 ..... B25B 15/02
FR 2831088 A1 * 4/2003 ..... B25B 1/046
GB 191102144 A * 0/1912 ..... B25G 1/046

* cited by examiner

*Primary Examiner* — Joseph J Hail
*Assistant Examiner* — Joel Crandall
(74) *Attorney, Agent, or Firm* — Muncy, Geissler, Olds & Lowe, P.C.

(57) ABSTRACT

A precision handle for hand tools has a body, an elastic element, a sheath, a pressing element, and a group of balls. The mounting protrusion protrudes axially from a rear end of the body. The elastic element is mounted in the body. The sheath is mounted around the mounting protrusion. The pressing element is mounted through and engages with the sheath. The group of balls includes a first ball and a second ball. The first ball is mounted in the mounting protrusion and abuts the elastic element. The second ball is mounted between the pressing element and the first ball. The first ball abuts against the second ball at one point of contact when the pressing element is pressed, thereby decreasing the friction between the body and the sheath. Accordingly, the precision handle for hand tools can be operated smoothly and efficiently.

8 Claims, 7 Drawing Sheets

PRECISION HANDLE FOR HAND TOOLS

FIELD

The present invention relates to an apparatus for hand tools, and more particularly to a precision handle for hand tools that can facilitate smooth and efficient operation of the hand tools.

BACKGROUND

This section provides background information related to the present disclosure which is not necessarily prior art.

With reference to FIG. 7, when a hand tool is used in a precision environment, a conventional precision handle is mounted on a holding end of the hand tool to form a precision hand tool to prevent the hand tool from oscillating in use. The precision hand tool can remain steady and lineal during operation. So the precision hand tool is applied to the tiny screws of glasses, mobile phones or computers. The conventional precision handle comprises a body 80 and a positioning element 90. The body 80 is a rod and has a front end, a rear end, a mounting protrusion 81, and a tool head 82. The mounting protrusion 81 is formed axially on and protrudes from the rear end of the body 80. The positioning element 90 is a circular cap and is mounted around the mounting protrusion 81. The tool head 82 is assembled at the front end of the body 80 when the hand tool is operated. In use, the tool head 82 is inserted into a screw, one hand of the user holds the positioning element 90, and the other hand rotates the body 80. The tool head 82 would rotate when the body 80 rotates, so as to fasten or loosen the screw.

However, the positioning element 90 is mounted around the mounting protrusion 81 directly, and the mounting protrusion 81 engages the positioning element 90 in a surface-to-surface contact. Thus the friction between the mounting protrusion 81 and the positioning element 90 increases when the body 80 rotates, and makes users unable to operate the precision hand tool smoothly.

To overcome the shortcomings of the conventional precision handle for hand tools, the present invention provides a precision handle for hand tools to mitigate or obviate the aforementioned problems.

SUMMARY

This section provides a general summary of the disclosure, and is not a comprehensive disclosure of its full scope or all of its features.

An aspect of the present invention is to provide a precision handle which could be operated smoothly and efficiently.

The precision handle for hand tools has a body, an elastic element, a sheath, a pressing element, and a group of balls. A mounting protrusion protrudes axially from a rear end of the body. The elastic element is mounted in the body. The sheath is mounted around the mounting protrusion. The pressing element is mounted through and engages with the sheath. The group of balls includes a first ball and a second ball. The first ball is mounted in the mounting protrusion and abuts the elastic element. The second ball is mounted between the pressing element and the first ball. The first ball abuts the second ball at one point of contact when the pressing element is pressed, which can decrease the friction between the body and the sheath. So the precision handle for hand tools may be operated smoothly and efficiently.

Other aspects, advantages, and novel features of the invention will become more apparent from the following detailed description when taken in conjunction with the accompanying drawings.

DRAWINGS

The drawings described herein are for illustrative purposes only of a selected embodiment and not all possible implementations, and are not intended to limit the scope of the present disclosure.

DETAILED DESCRIPTION

An example embodiment will now be described more fully with reference to the accompanying drawings.

Figure 1:
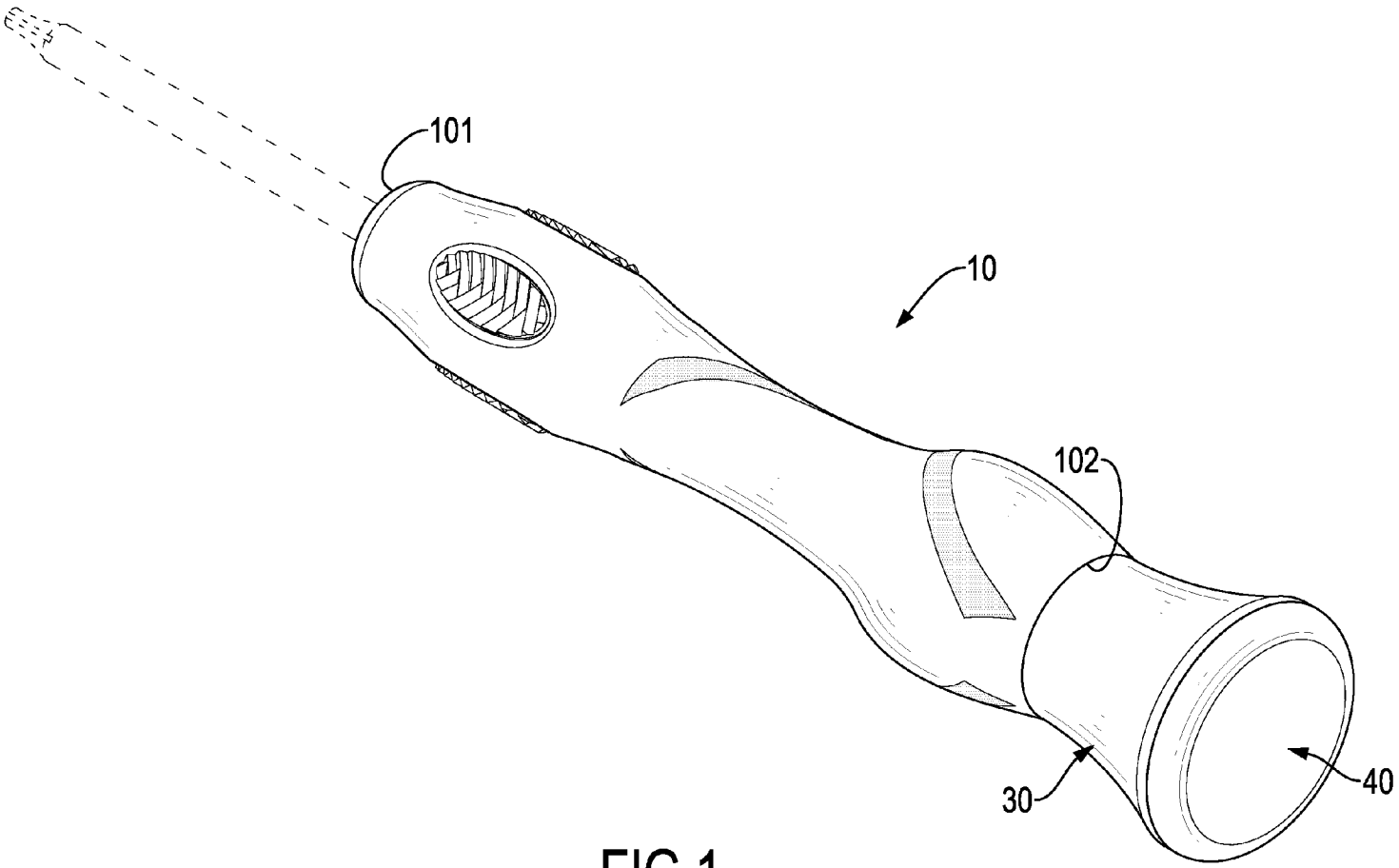
FIG. 1 is a perspective view of a precision handle for hand tools in accordance with an exemplary embodiment of the present invention.
Figure 2:
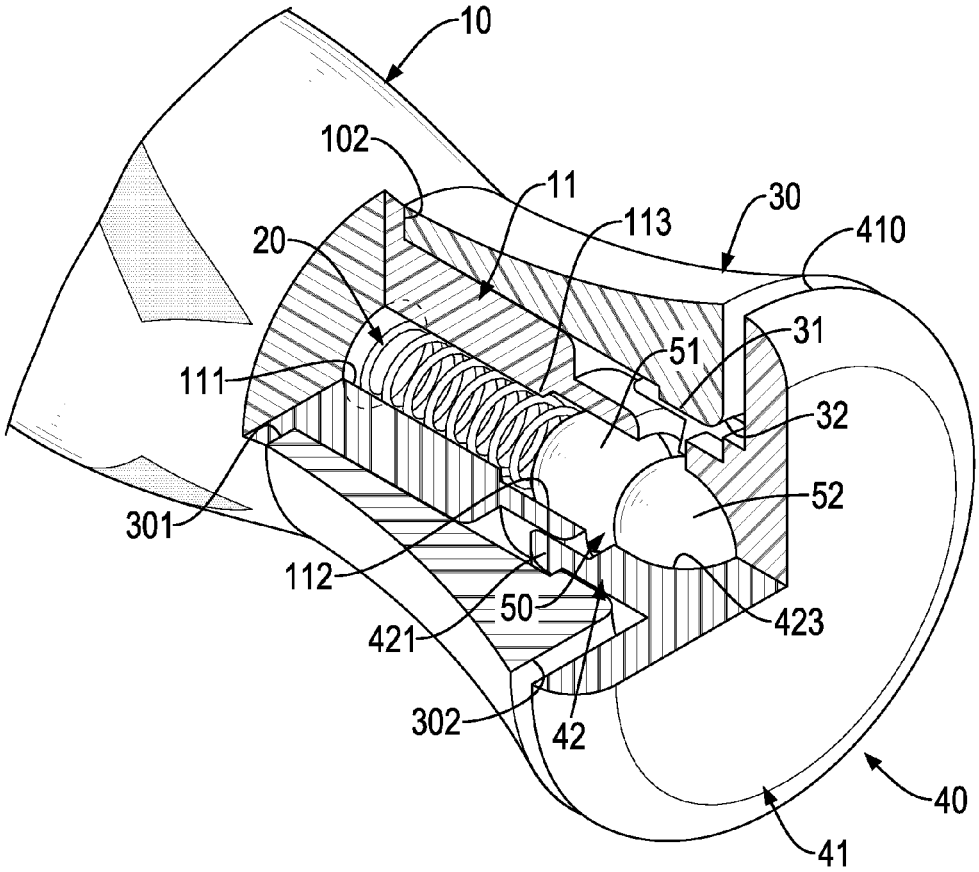
FIG. 2 is an enlarged perspective view in partial section of the precision handle in FIG. 1.
Figure 3:
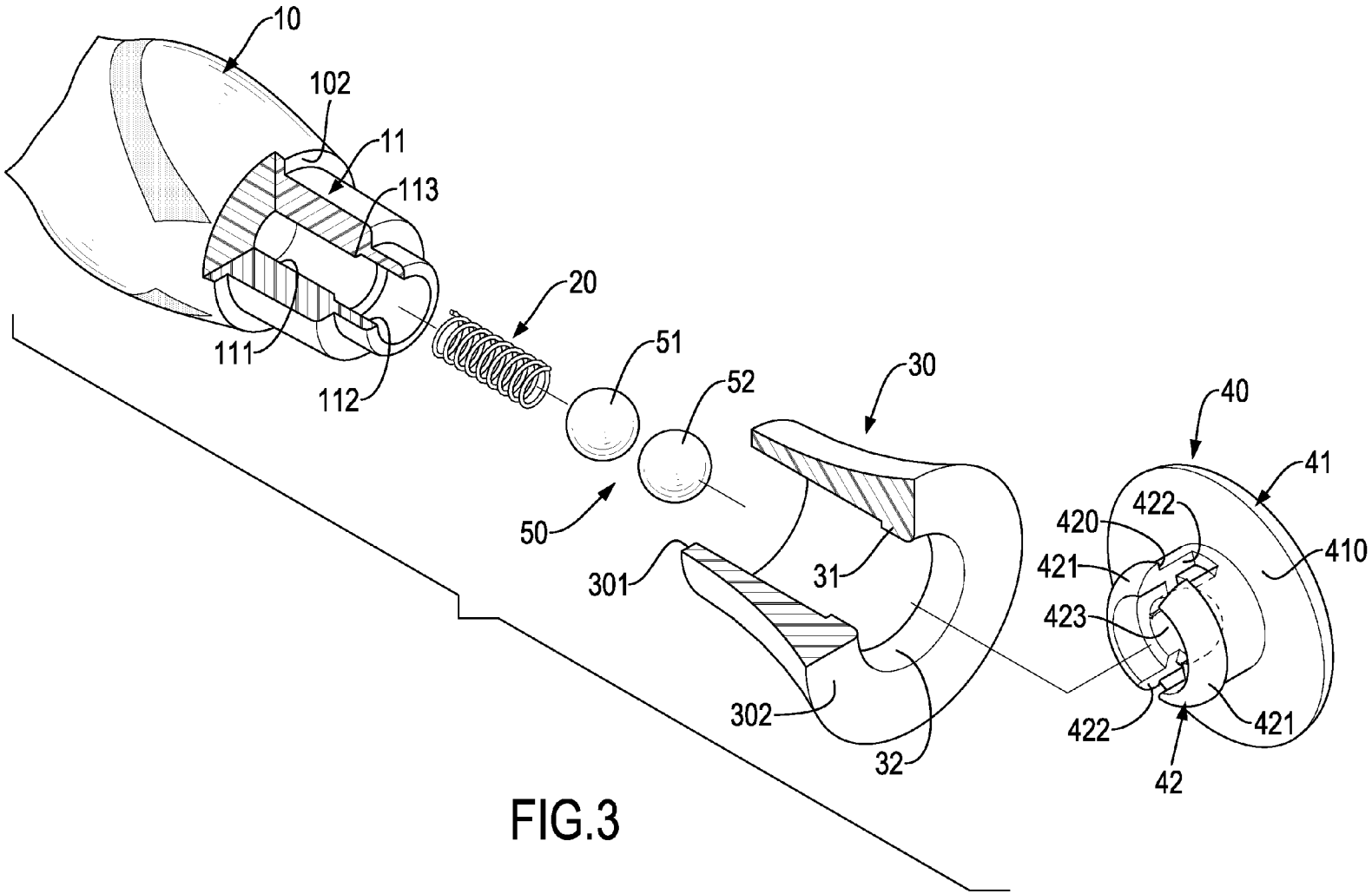
FIG. 3 is an exploded perspective view in partial section of the precision handle in FIG. 1.

With reference to FIGS. 1 to 3, a precision handle for hand tools in accordance with an exemplary embodiment of the present invention comprises a body 10, an elastic element 20, a sheath 30, a pressing element 40, and a group of balls 50.

The body 10 is rod-shaped and has a front end 101, a rear end 102, and a mounting protrusion 11. A tool head may be mounted in the front end 101 of the body 10. The mounting protrusion 11 is axially formed on and protrudes from the rear end 102 of the body 10 and comprises a rear side, a mounting recess 111, a through hole 112, and a limiting circular rib 113. The rear side of the mounting protrusion 11 is opposite to the rear end 102 of the body 10 and has an inner diameter. The mounting recess 111 is formed in the mounting protrusion 11 adjacent to the rear end 102 of the body 10. The through hole 112 is formed through the rear side of the mounting protrusion 11 and has an inner diameter. The inner diameter of the through hole 112 is larger than an inner diameter of the mounting recess 111. The limiting circular rib 113 is formed in the mounting protrusion 11 at a connecting portion between the mounting recess 111 and the through hole 112. The limiting circular rib 113 is tapered from the through hole 112 toward the mounting recess 111.

The elastic element 20 is mounted in the mounting recess 111 via the through hole 112. Preferably, the elastic element 20 is a spring.

The sheath 30 may be a tapered tube, is securely mounted around the mounting protrusion 11 of the body 10, and comprises an inner surface, a proximal end 301, a distal end 302, a positioning circular rib 31, and a connecting hole 32. The proximal end 301 of the sheath 30 abuts the rear end 102 of the body 10. The distal end 302 of the sheath 30 is opposite to the proximal end 301. The positioning circular rib 31 is formed radially inward on the inner surface of the sheath 30 adjacent the distal end 302 of the sheath 30. The connecting hole 32 is formed through the distal end 302 of the sheath 30 and communicates with the through hole 112.

Figure 4:
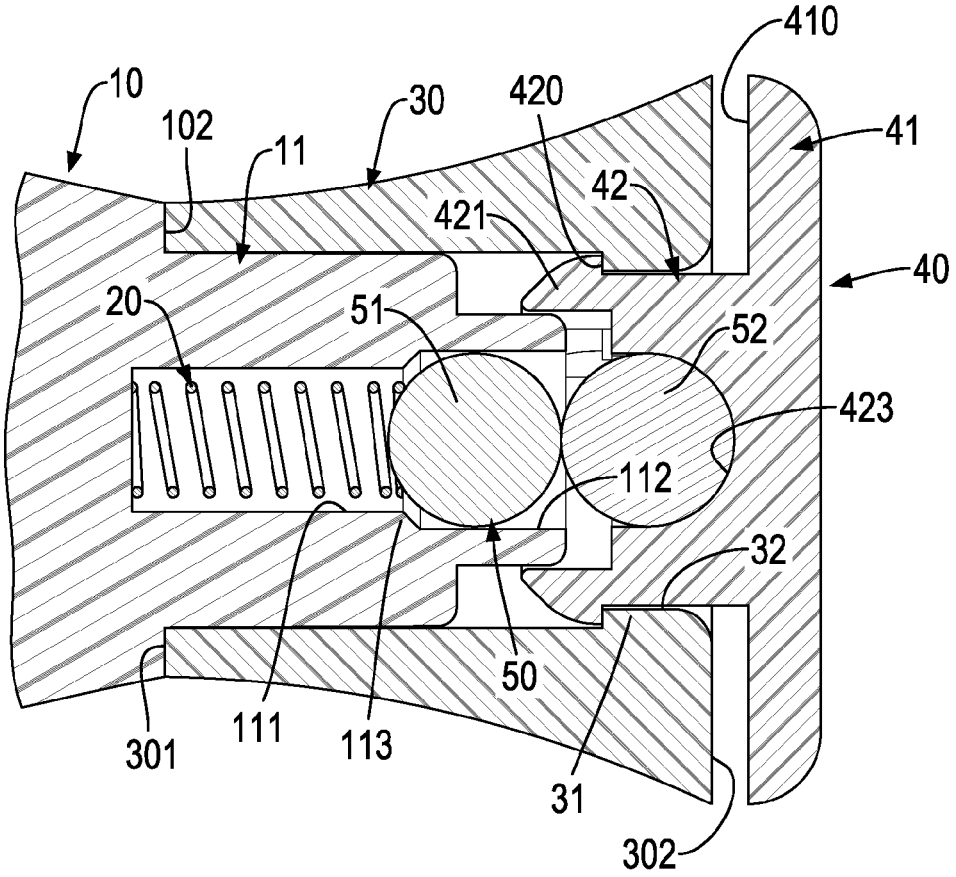
FIG. 4 is an enlarged and cross sectional side view of the precision handle in FIG. 1.

With reference to FIG. 4, the pressing element 40 is mounted through and engages with the sheath 30 and comprises a pressing disk 41 and an embedded portion 42. The pressing disk 41 has a proximal face 410 and a distal face. The proximal face 410 faces the distal end 302 of the sheath 30. The embedded portion 42 is formed axially on and protrudes from the proximal face 410 of the pressing disk 41 toward the mounting protrusion 11 and is mounted around the rear side of the mounting protrusion 11 via the connecting hole 32.

The embedded portion 42 has an outer surface, a proximal side 420, an engaging circular rib 421, two constricting recesses 422, and an embedding recess 423. The proximal side 420 is opposite to the proximal face 410 of the pressing element 40. The engaging circular rib 421 is formed radially outward on the embedded portion 42 at the proximal side 420 of the embedded portion 42. The engaging circular rib 421 engages the positioning circular rib 31 of the sheath 30, and this enables the pressing element 40 to be connected to the sheath 30 without separating. The two constricting recesses 422 are formed through the outer surface of the embedded portion 42 and the engaging circular rib 421 radially, thereby making the embedded portion 42 deformable. The two constricting recesses 422 face to each other. The embedding recess 423 is formed in the proximal side 420 of the embedded portion 42 axially and is a circular recess. The embedding recess 423 communicates with the two constricting recesses 422.

The group of balls 50 is mounted in the sheath 30 between the mounting protrusion 11 of the body 10 and the pressing element 40. The group of balls 50 comprises a first ball 51 and a second ball 52. The first ball 51 is mounted in the mounting protrusion 11 via the through hole 112 and has a front side. A diameter of the first ball 51 is smaller than the inner diameter of the through hole 112, while the diameter of the first ball 51 is larger than the inner diameter of the mounting recess 111. The first ball 51 is located in the through hole 112, and the front side of the first ball 51 extends in the mounting recess 111 to enable the first ball 51 to abut the elastic element 20. The second ball 52 is embedded in the embedding recess 423 of the pressing element 40 and abuts the first ball 51 at one point of contact due to the pushing force between the elastic element 20 and the first ball 51. An annular gap is formed between the distal end 302 of the sheath 30 and the pressing disk 41 of the pressing element 40.

Figure 5:
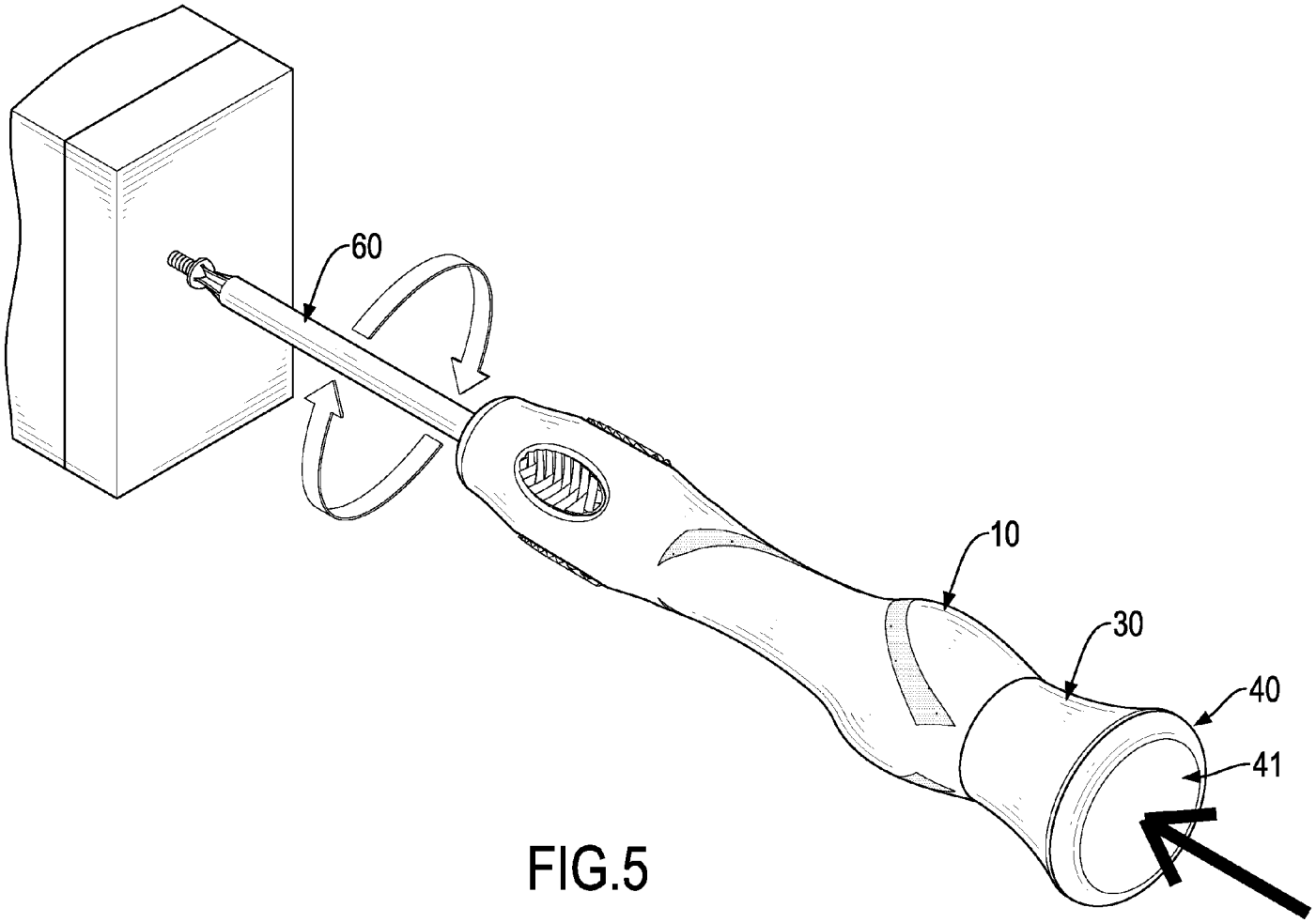
FIG. 5 is an operational perspective view of the precision handle in FIG. 1.
Figure 6:
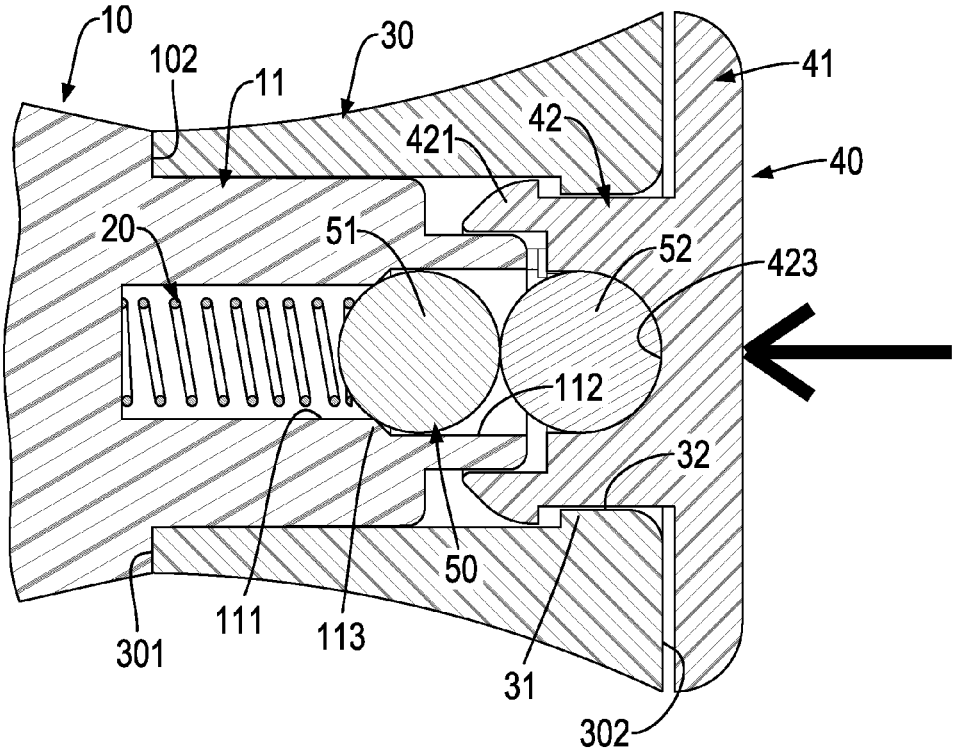
FIG. 6 is an operational enlarged side view of the precision handle in FIG. 1.
Figure 7:
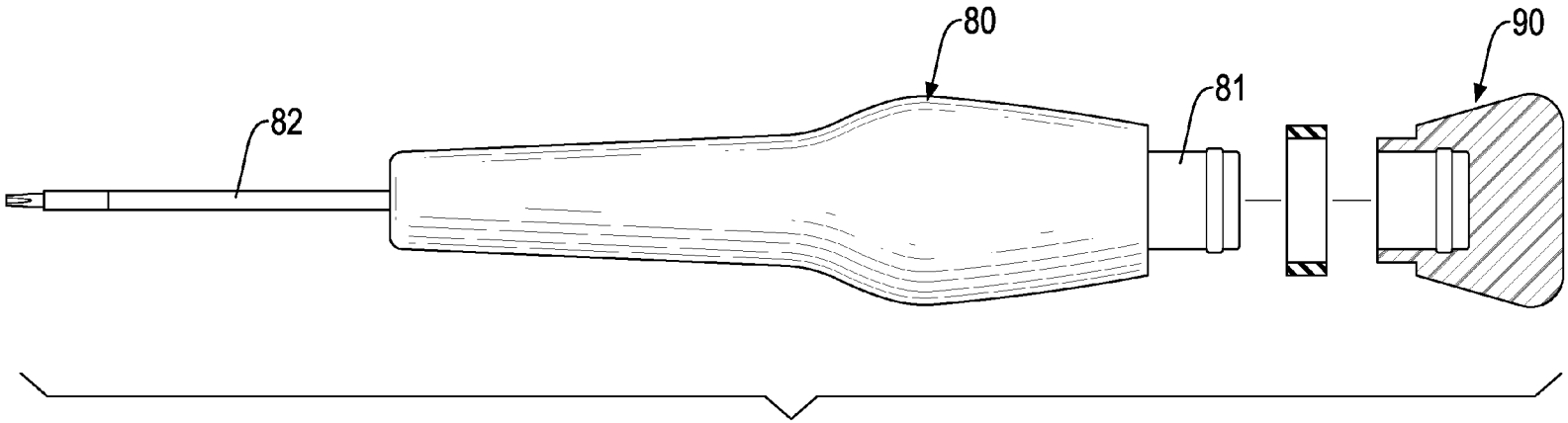
FIG.7 PRIOR ART
FIG. 7 is an exploded side view of a precision handle for a hand tool in accordance with the prior art.

In use, with reference to FIG. 5 and FIG. 6, a tool head 60 is assembled at the front end 101 of the body 10, and then the tool head 60 is inserted into a screw. One hand of a user presses the pressing element 40, making the pressing element 40 move toward the screw. While the pressing element 40 approaches the screw, the second ball 52 pushes the first ball 51. The front side of the first ball 51 extends to the mounting recess 111 more deeply and abuts the limiting circular rib 113, and then the first ball 51 compresses the elastic element 20. During the operating process, the first ball 51 continually contacts the second ball 52 at one point of contact. At the same time, the engaging circular rib 421 is separated from the positioning circular rib 31 when the pressing element 40 is pushed to move relative to the sheath 30. The other hand of the user holds the body 10, and rotates the body 10 with the tool head 60 in a clockwise or a counter-clockwise direction, thereby fastening or loosening the screw. The screw, the body 10 and the pressing element 40 may remain precisely aligned linearly while the body 10 is rotating, which ensures the tool head 60 is operated precisely. Because the first ball 51 continually touches the second ball 52 at one point of contact while the body 10 is rotating, the friction between the body 10 and the pressing element 40 is decreased.

Compared with the conventional precision handle, wherein the mounting protrusion 81 engages the positioning element 90 in a surface-to-surface contact, the friction between the mounting protrusion 81 and the positioning element 90 is increased, and users are unable to operate the precision hand tool smoothly. The precision handle for hand tools of the present invention has the following advantages.

1. The first ball 51 continually touches the second ball 52 at one point of contact, which may decrease the friction between the body 10 and the pressing element 40. Thus the precision handle can be operated more smoothly and more efficiently.

2. The screw, the body 10 and the pressing element 40 may stay precisely aligned and linear while the precision handle is operated. Thus the precision handle may maintain its precision since the friction between the body 10 and the pressing element 40 decreases.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A precision handle for hand tools comprising:
- a body having:
- a front end;
- a rear end; and
- a mounting protrusion axially protruding from the rear end of the body and having a rear side at a distance from the rear end of the body;
- a mounting recess made in the mounting protrusion adjacent to the rear end of the body;
- a through hole made in the rear side of the mounting protrusion and having an inner diameter; and
- a limiting circular rib formed in the mounting protrusion at a connecting portion between the mounting recess and the through hole;
- an elastic element inserted in the mounting recess;
- a sheath mounted around the mounting protrusion of the body and having an internal face;
- a proximal end abutting the rear end of the body;
- a distal end being opposite to the proximal end;
- a positioning circular rib formed on the internal face of the sheath adjacent to the distal end of the sheath; and
- a connecting hole made in the distal end of the sheath and in communication with the through hole;
- a pressing element extending through and engaging with the sheath and having:
- an embedded portion having:
  - an external face;
  - a proximal side facing the mounting recess;
  - an engaging circular rib formed on an external face of the embedded portion at the proximal side of the embedded portion; and
  - an embedding recess made in the proximal side of the embedded portion and being a circular recess; and a group of balls inserted in the sheath between the mounting protrusion of the body and the pressing element and wherein the group of balls includes:

a first ball inserted in the mounting protrusion via the through hole and having a front side extending in the mounting recess to enable the first ball to abut the elastic element; and a second ball inserted in the embedding recess of the pressing element and abutting the first ball.

2. The precision handle as claimed in claim 1, wherein the embedded portion has two constricting recesses, the two constricting recesses are made in the external face of the embedded portion and the engaging circular rib radially, and the two constricting recesses communicate with the embedding recess.

3. The precision handle as claimed in claim 2, wherein the elastic element is a spring.

4. The precision handle as claimed in claim 3, wherein the pressing element has a pressing disk, the pressing disk has a proximal face facing the distal end of the sheath, the embedded portion is formed axially on and protrudes from the proximal face of the pressing disk toward the mounting protrusion, and a gap is made between the distal end of the sheath and the pressing disk of the pressing element.

5. The precision handle as claimed in claim 2, wherein the pressing element has a pressing disk, the pressing disk has a proximal face facing the distal end of the sheath, the embedded portion is formed axially on and protrudes from the proximal face of the pressing disk toward the mounting protrusion, and a gap is made between the distal end of the sheath and the pressing disk of the pressing element.

6. The precision handle as claimed in claim 1, wherein the pressing element has a pressing disk, the pressing disk has a proximal face facing the distal end of the sheath, the embedded portion is formed axially on and protrudes from the proximal face of the pressing disk toward the mounting protrusion, and a gap is made between the distal end of the sheath and the pressing disk of the pressing element.

7. The precision handle as claimed in claim 1, wherein the elastic element is a spring.

8. The precision handle as claimed in claim 7, wherein the pressing element has a pressing disk, the pressing disk has a proximal face facing the distal end of the sheath, the embedded portion is formed axially on and protrudes from the proximal face of the pressing disk toward the mounting protrusion, and a gap is made between the distal end of the sheath and the pressing disk of the pressing element.

* * * * *